US008726449B2

(12) United States Patent
Gallardo

(10) Patent No.: US 8,726,449 B2
(45) Date of Patent: May 20, 2014

(54) ADJUSTABLE LENGTH PAINT ROLLER

(75) Inventor: Jose Antonio Gallardo, Castaic, CA (US)

(73) Assignee: Arigala Painting, Inc., Castaic, CA (US)

( * ) Notice: Subject to any disclaimer, the term of this patent is extended or adjusted under 35 U.S.C. 154(b) by 0 days.

(21) Appl. No.: 13/561,531

(22) Filed: Jul. 30, 2012

(65) Prior Publication Data

US 2014/0013530 A1 Jan. 16, 2014

Related U.S. Application Data

(63) Continuation-in-part of application No. 13/547,964, filed on Jul. 12, 2012.

(51) Int. Cl.
*B05C 1/08* (2006.01)
*B05C 17/02* (2006.01)

(52) U.S. Cl.
USPC ..... 15/230.11; 492/19

(58) Field of Classification Search
USPC ..... 15/230.11; 492/17, 19
See application file for complete search history.

(56) References Cited

U.S. PATENT DOCUMENTS

| | | | | |
|---|---|---|---|---|
| 3,310,831 | A | 3/1967 | Brinker | |
| 3,593,361 | A | 7/1971 | Welt | |
| 3,745,624 | A * | 7/1973 | Newman | 492/19 |
| 4,402,102 | A * | 9/1983 | Al-samman | 15/230.11 |
| 4,644,604 | A * | 2/1987 | Kierce | 15/244.2 |
| 4,868,946 | A | 9/1989 | Marino et al. | |
| 5,490,303 | A * | 2/1996 | Graves | 15/230.11 |
| 5,713,095 | A | 2/1998 | Wakat | |
| 5,970,568 | A | 10/1999 | Mulcahy, Sr. | |
| 5,983,437 | A | 11/1999 | Wakat | |
| 6,284,318 | B1 * | 9/2001 | Jackson | 427/260 |
| 6,681,438 | B2 | 1/2004 | Newman et al. | |

* cited by examiner

*Primary Examiner* — Laura C Guidotti
(74) *Attorney, Agent, or Firm* — Kelly & Kelley, LLP

(57) ABSTRACT

An adjustable length paint roller frame with a handle and a roller arm. The frame includes a rotatable roller cover lock slidably mounted on the roller arm and a rotatable end cap. A roller cover is also mounted on the roller arm in between the roller cover lock and the end cap. The roller cover lock and end cap allow for roller covers of different lengths and diameters to be used with the adjustable length paint roller frame. The end cap can also include adjustable roller guides to space the roller cover a desired distance away from a given object. Additionally, the roller frame handle may be configured as a split handle that accommodates a second roller arm.

13 Claims, 10 Drawing Sheets

ADJUSTABLE LENGTH PAINT ROLLER

BACKGROUND OF THE INVENTION

The present invention relates generally to paint rollers. More particularly this invention relates to paint rollers that are used with roller covers of various sizes.

Paint rollers allow a user to paint larger areas with less effort than is required with a traditional paint brush. A standard paint roller includes a wire frame with a handle and cantilevered roller arm. A roller cover is generally shaped as an elongated hollow cylinder covered in an absorbent material and is pushed in place over a wire cage situated around the cantilevered roller arm. The wire cage has a circumference that allows for a tight fit with the inner diameter of the roller cover. The user rolls the paint roller through a tray of paint until the absorbent material is saturated with the desired amount of paint. The paint roller is then rolled over the surface to be painted. Standard paint roller frames accommodate one length of roller cover. If the user tries to work with a smaller roller on the standard frame, the smaller roller will tend to slide off the roller arm. So in order to paint an area with different size roller covers, different roller frames must usually be employed.

The prior art in this field includes patents directed at paint roller frames that accommodate paint rollers of different lengths and diameters. (See e.g., U.S. Pat. No. 3,310,831; U.S. Pat. No. 3,593,361; U.S. Pat. No. 4,868,946; U.S. Pat. No. 6,681,438) These references, however, teach paint roller frames where the paint roller is supported by two adjustable arms, rather than the standard single cantilevered arm. Thus, the prior art does not teach a way to utilize a standard cantilevered paint roller frame with roller covers of different sizes. There exists, therefore, a need for improvements in and to paint rollers in order to allow a standard paint roller frame to be successfully utilized with roller covers of different lengths and diameters. The present invention fulfills these needs and provides further related advantages.

SUMMARY OF THE INVENTION

The present invention is directed to an adjustable length paint roller frame. The roller frame comprises a frame with two ends. There is a handle at the first end and an arm at the second end. A rotatable roller cover lock is slidably mounted on the arm and is removably attached to a rotatable roller cover, also mounted on the arm. A rotatable end cap is also removably mounted to the arm adjacent to the roller cover.

The roller cover comprises absorbent material such as fabric, foam, lamb's wool or mohair, such that the exterior of the roller cover can hold and apply quantities of paint to another surface. The roller cover lock slidably mounted on the arm is sized to create a tight fit with an interior of the roller cover. The roller cover lock may also include means for enhancing the tight fit with the interior of the roller cover. The means for enhancing the tight fit can be fins or gripping teeth extending from the outer perimeter of the roller cover lock.

The end cap is removably attached to the arm via a screw, a clamp, or a clip, and may also include an absorbent cover. The end cap absorbent cover may comprise fabric, foam, lamb's wool or mohair. Alternately, the end cap may comprise an adjustable length roller guide. The adjustable length roller guide is extendable and spaces the roller cover a larger or smaller distance away from a given object.

The roller frame handle may also comprise a first lever pivotally connected to a second lever. In this embodiment, the roller frame arm is attached to the first lever, and an optional second arm may be attached to the second lever. This embodiment may further include locking means between the first and second levers, such that the two levers may be utilized as a single handle.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
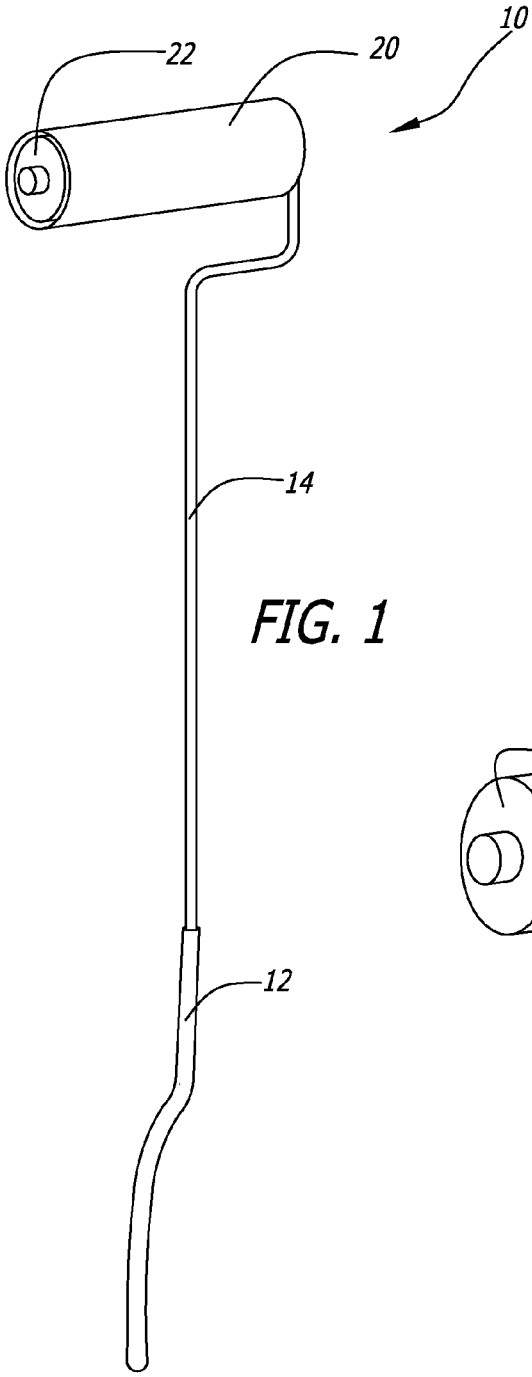
FIG. 1 is a perspective view of the adjustable length paint roller frame of the present invention.

As shown in the exemplary drawings, an adjustable length paint roller frame, referred to generally in the figures by the reference numeral 10, is provided for more conveniently painting walls, pillars, chairs, fences and other surfaces. As shown in FIG. 1, the adjustable length paint roller frame 10 comprises a handle 12 and a roller arm 14. The roller arm 14 is mounted with a roller cover lock 16, a roller cover 20, and an end cap 22, as in FIG. 2.

Figure 2:
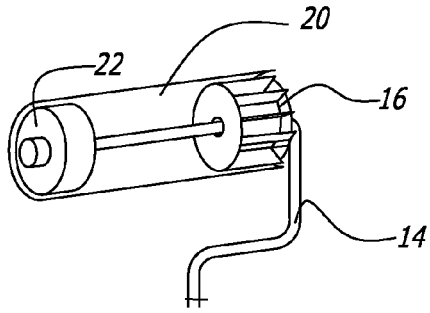
FIG. 2 is a close-up view of the roller arm and roller cover cut away to illustrate the placement of the roller cover lock and end cap.
Figure 3:
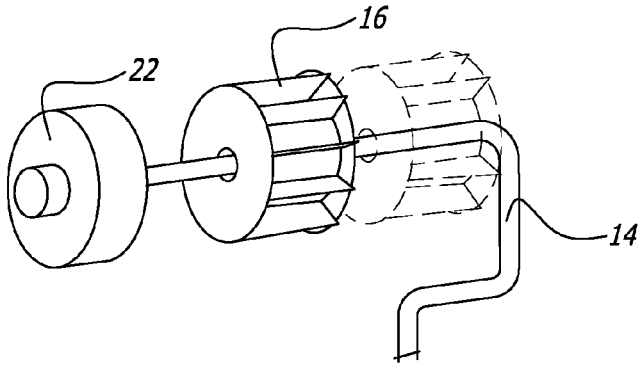
FIG. 3 illustrates the direction of movement for the roller cover lock.
Figure 4:
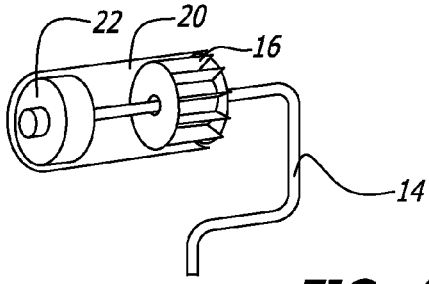
FIG. 4 illustrates the roller cover lock's use in combination with a shorter cover.

FIG. 2 shows a cut-away view of the roller cover lock 16 and the end cap 22 in use with a roller cover 20. The roller cover lock 16 and end cap 22 serve to keep the roller cover 20 in place on the roller arm 14, and also prevent the roller cover 20 from collapsing against the roller arm 14. The roller cover lock 16 is rotatable about the roller arm 14, but is also slidable along the length of the roller arm 14, as shown in FIG. 3. The slidability of the roller cover lock 16 allows for the adjustable length paint roller frame 10 to be used with roller covers 20 of different sizes. In FIG. 4, a shorter roller cover 20 is shown in use with the roller cover lock 16 and the end cap 22.

Figure 5:
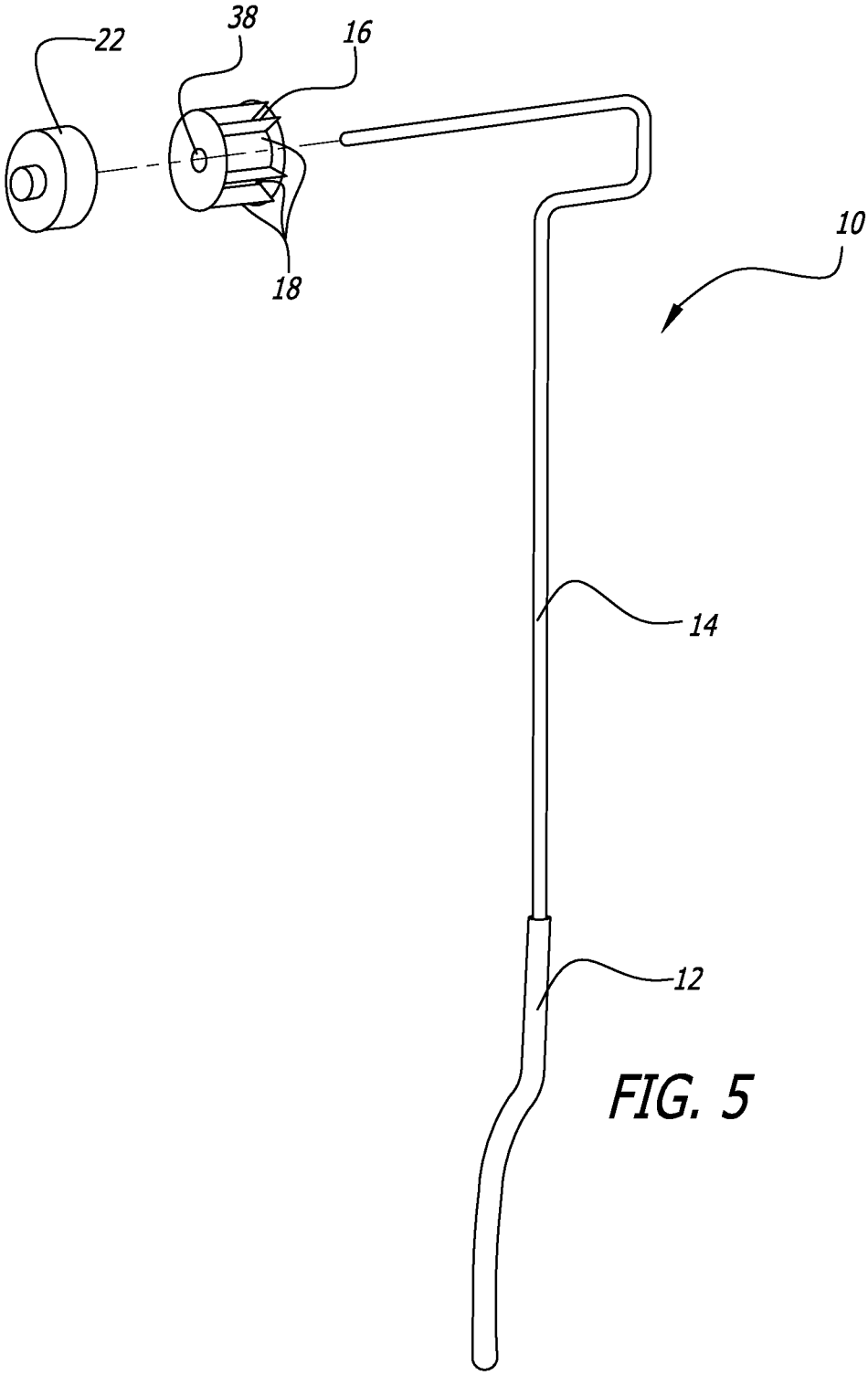
FIG. 5 is an exploded perspective view of the adjustable length paint roller frame of FIG. 1 showing the preferred placement of the roller cover lock and end cap.

In FIG. 5, an exploded view of the adjustable length paint roller frame is shown, illustrating the preferred placement of the roller cover lock 16 and the end cap 22 on the roller arm 14. The roller cover lock 16 slides onto the roller arm first through a central aperture 38. The central aperture 38 is large enough to slide over the roller arm 14 and remain rotatable thereon. Next, a roller cover 20 is mounted on the roller arm 14 over the roller cover lock 16 (as shown in FIGS. 2 and 4). The roller cover lock 16 also features means 18 for enhancing the tight fit between the roller cover lock 16 and the roller cover 20. In the preferred embodiment, these means 18 are fins radiating from the center of the roller cover lock 16. The fins extend just beyond the outer circumference of the roller cover lock 16, and are made of a flexible material such as plastic, aluminum, tin, or the like. In other embodiments, the means 18 for enhancing the tight fit between the roller cover lock 16 and the roller cover 20 may be gripping teeth, or other similar means. Once a roller cover 20 is pushed over the roller cover lock 16, the means 18 interact with the interior of the roller cover 20 such that a very tight fit between the two is created. The placement of the roller cover 20 on the roller cover lock 16 is not permanent, but some force would be required to remove the roller cover 20 from the roller cover lock 16.

Figure 6:
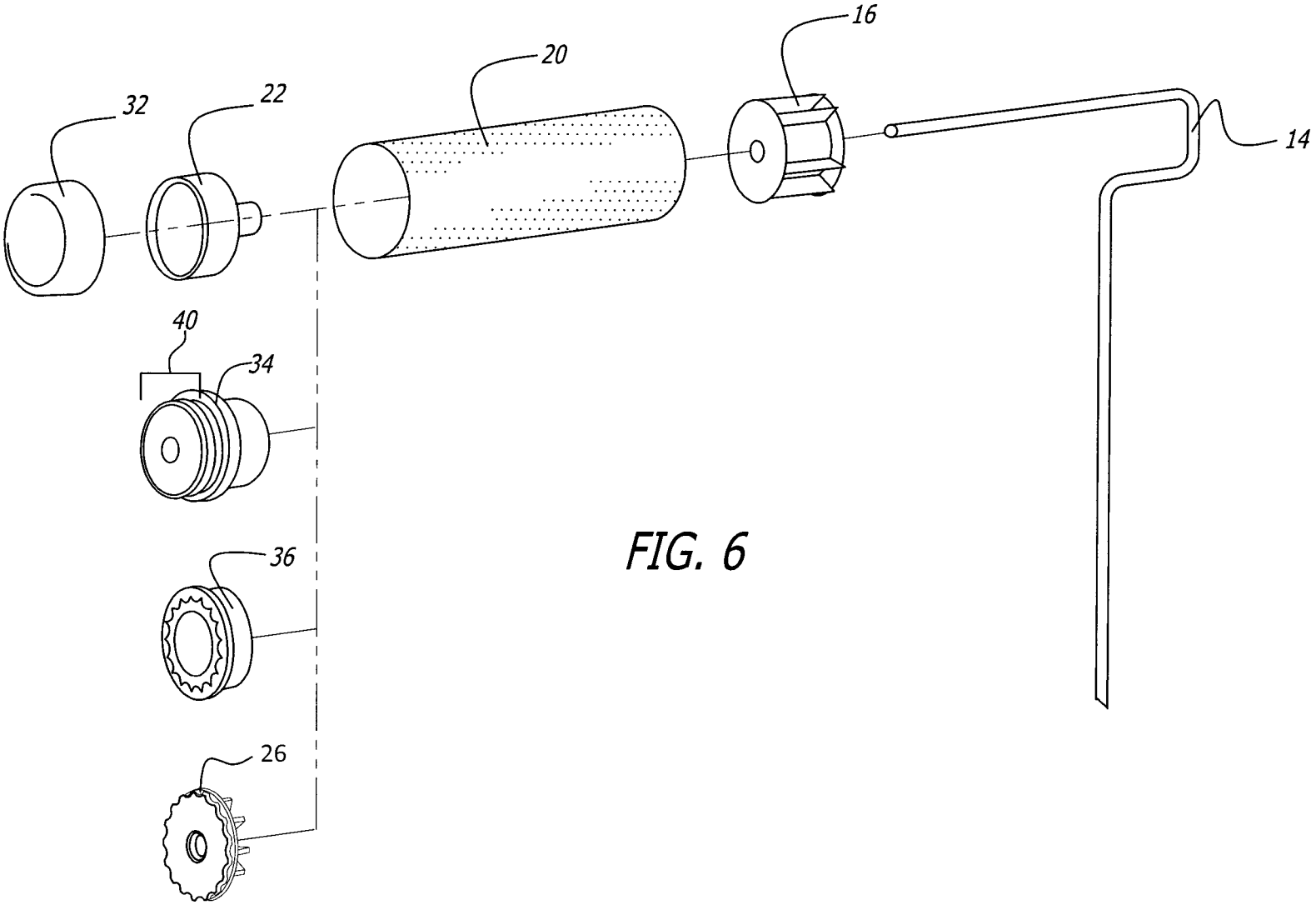
FIG. 6 is an exploded perspective view, illustrating the selection of end caps available for use with the roller cover and roller cover lock.

In FIG. 6, the roller arm 14, roller cover lock 16, and roller cover 20 are shown with the standard end cap 22 along with other end cap embodiments. The basic end cap 22 fits tightly within the interior of the roller cover 20 and attaches to the end of the roller arm 14. The end cap 22 may attach to the roller arm 14 with a screw, or with clips, clamps, or the like. The end cap 22 has a flat exterior side that is almost flush with the end of the roller cover 20 once in place. In another embodiment, any portion of the end cap 22 that extends beyond the end of the roller and can be covered with an absorbent cap 32. The absorbent cap 32 is made of similar material as found in the roller cover 20; namely, fabric, foam, lamb's wool or mohair. With the absorbent cap 32 in place, the adjustable length paint roller frame 10 can be used to paint into corners between two walls.

Other end cap embodiments are also illustrated in FIG. 6. The extended end cap 34 features a protruded portion 40 that extends beyond the end of the roller cover 20, when the extended end cap 34 is in place. The protruded portion 40 acts as a spacer that ensures the paint roller will not go past a certain distance toward a given object. For example, when painting around a window sill, the extended end cap 34 can be used. The adjustable length paint roller frame 10 can be guided along the edge of the window sill, but the paint will not be transferred onto the window sill because the extended end cap 34 spaces the roller cover 20 a given distance away from any given object.

Similarly, the notched end cap 36 is useful for edging when painting into a corner between two walls of different colors. The notched end cap 36 extends slightly beyond the end of the roller cover 20, allowing the roller cover 20 to come very close to the other wall without transferring paint onto the other wall. Alternately, the end cap can be an adjustable length roller guide 26, which allows for the roller cover 20 to be spaced a variable distance away from a given object, as described below.

Figure 7:
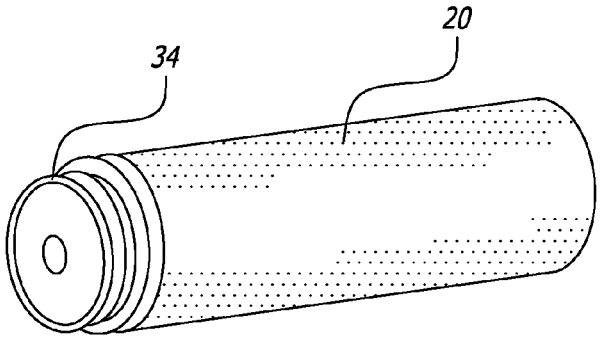
FIG. 7 is a perspective view of a smooth disk end cap fitted to the roller cover.
Figure 8:
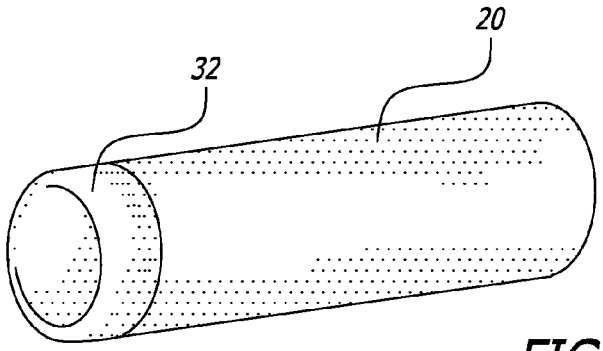
FIG. 8 is a perspective view of an absorbent covering end cap fitted to the roller cover.
Figure 9:
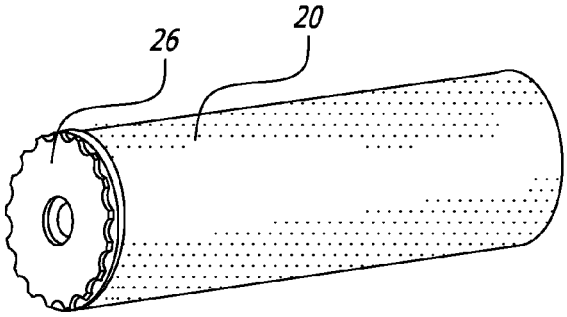
FIG. 9 is a perspective view of an adjustable length roller guide end cap fitted to the roller cover.
Figure 10:
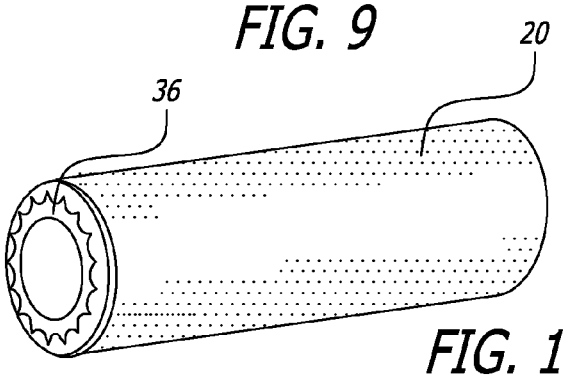
FIG. 10 is a perspective view of a notched disk end cap fitted to the roller cover.

FIGS. 7-10 show the roller cover 20 in combination with the different end caps. In FIG. 7, the roller cover 20 is used in combination with the extended end cap 34. In FIG. 8, the end cap is covered with the absorbent cap 32. In FIG. 9, the roller cover 20 is used in combination with the adjustable length roller guide 26. And in FIG. 10, the roller cover 20 is used in combination with the notched end cap 36.

Figure 11:
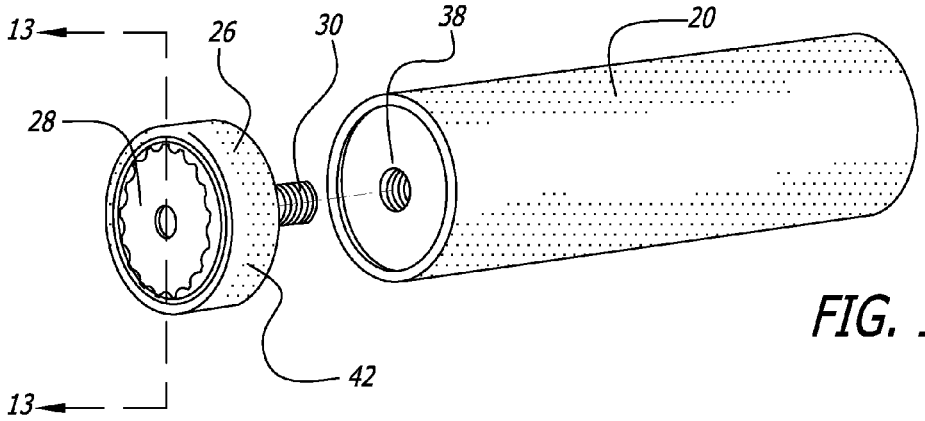
FIG. 11 is an exploded perspective view of the roller cover illustrating the adjustable length roller guide's placement in conjunction with the end cap.
Figure 12:
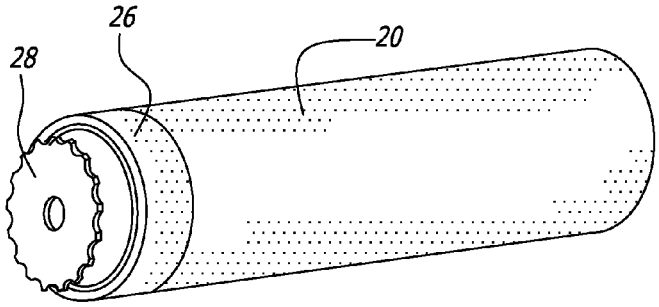
FIG. 12 is a perspective view of the roller cover of FIG. 11, illustrating the adjustable length roller guide in use once attached to the end cap.

FIGS. 11-14 illustrate the adjustable length roller guide 26. In FIG. 11, the adjustable length roller guide 26 is shown with a screw on the interior side toward the roller cover 20, and a notched disk 28 on the exterior side away from the roller cover 20. In this embodiment, the adjustable length roller guide 26 is also partially covered in absorbent material 42. Much like the roller cover 20, this absorbent material 42 can be fabric, foam, lamb's wool or mohair. The screw 30 fits within the corresponding aperture 38 at the end of the roller cover 20. The adjustable length roller guide 26 is shown in place at the end of the roller cover 20 in FIG. 12. The notched disk 28 is extendable from the end of the roller cover 20 thereby creating a space between the roller cover 20, and anything that the roller cover 20 might be pushed against.

Figure 13:
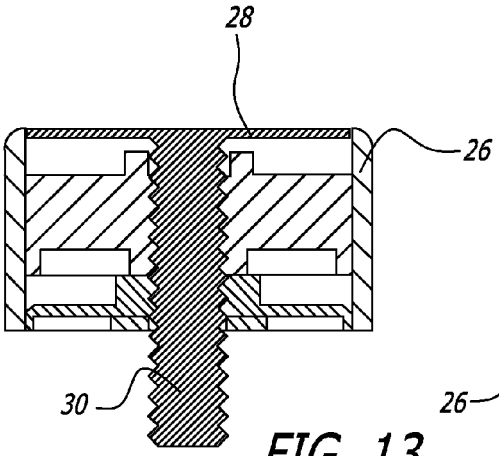
FIG. 13 is a sectional view taken along line 13-13 from FIG. 11, illustrating the placement of the inner screw when the roller guide is flush with the roller end cap.
Figure 14:
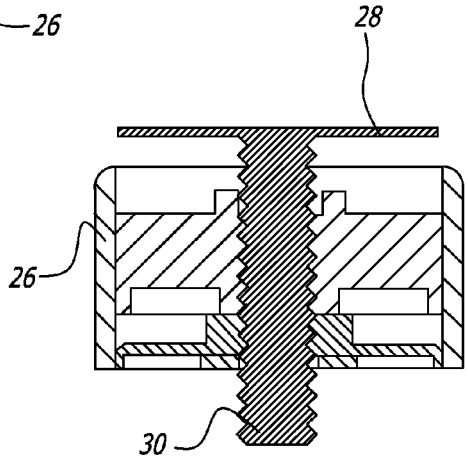
FIG. 14 is a sectional view similar to FIG. 42, illustrating the placement of the inner screw after the roller guide is extended away from the roller end cap.

FIG. 13 is taken along line 13-13 in FIG. 11 and illustrates the screw 30 attached to the notched disk 28 inside the adjustable length roller guide 26. FIG. 14 shows that the notched disk 28 and attached screw can be extended from the end of the roller cover 20 without becoming detached from the roller cover 20. The adjustable length roller guide 26 allows for the roller cover 20 to be spaced a variable distance away from any object that the roller frame 10 is being guided along.

Figure 15:
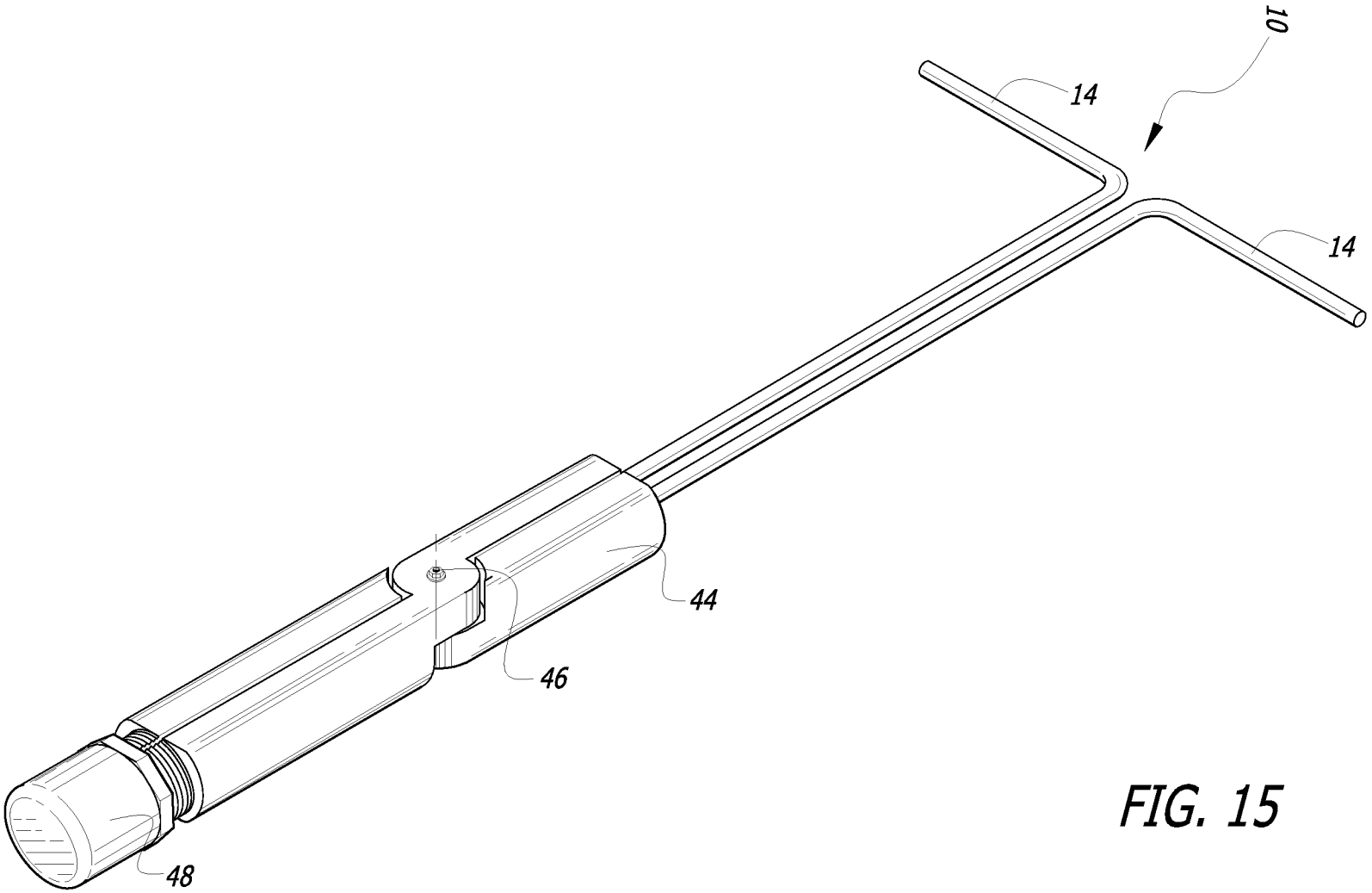
FIG. 15 is a perspective view of an embodiment of the adjustable length paint roller frame illustrating the split handle and second roller arm.

An embodiment of the adjustable length paint roller frame 10 is illustrated in FIGS. 15-26. This embodiment is shown in FIG. 15 and features a split handle 44 with two roller arms 14. The split handle 44 is manufactured from two levers, fastened at a pivot 46. The split handle can be scissored open, or can be locked together via the handle lock 48.

Figures 16, 17, 18, 19:
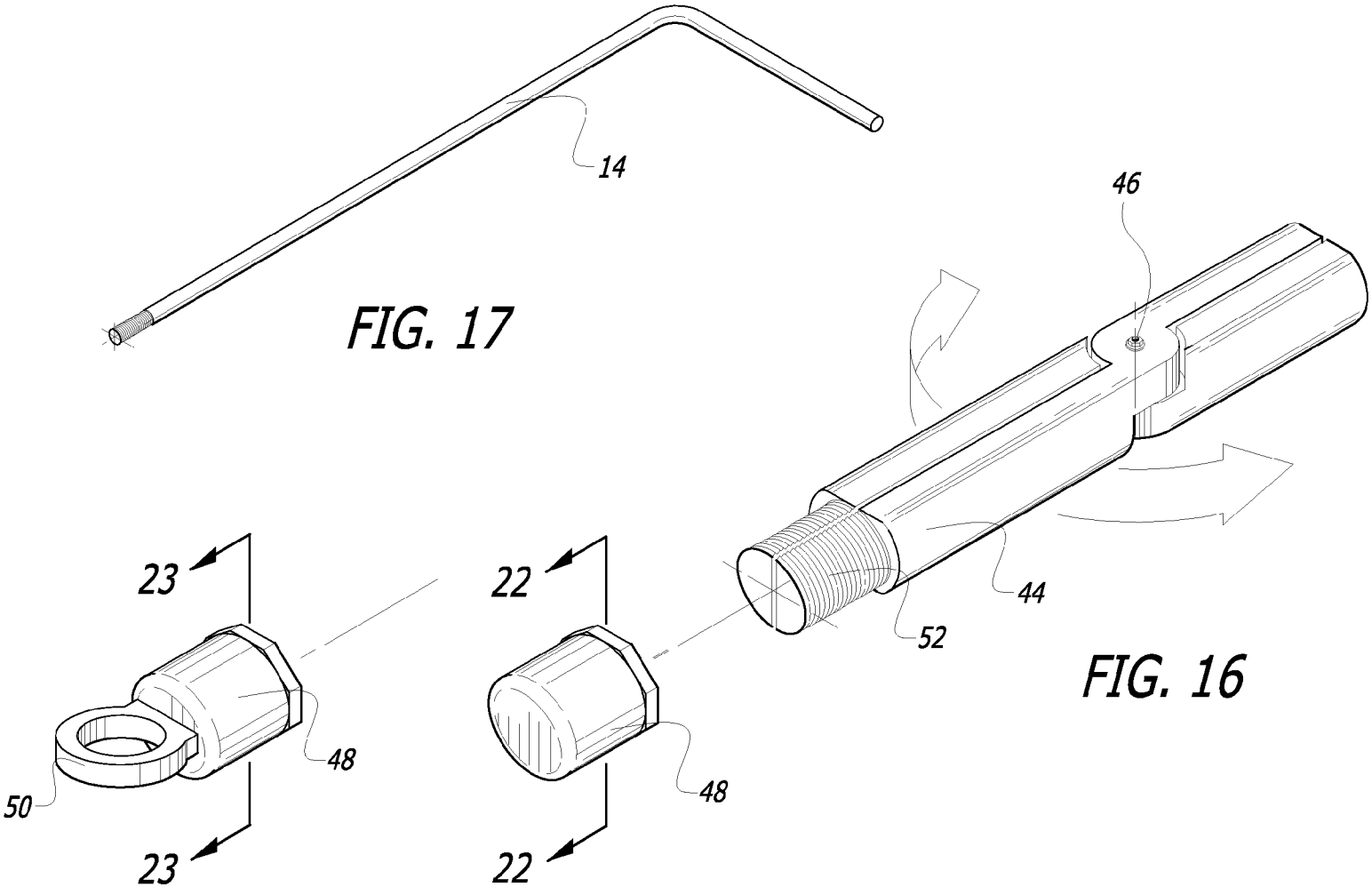
FIG. 16 is a perspective view of the split handle illustrating its direction of movement.
FIG. 17 is a perspective view of the roller arm disconnected from the handle.
FIG. 18 is a perspective view of the handle lock with utility loop.
FIG. 19 is a perspective view of the handle lock without the utility loop.

The scissor motion of the split handle 44 is better illustrated in FIG. 16. When the two levers of the split handle 44 are not locked via handle lock 48, they open about the pivot point 46 along the arrows as shown. FIG. 16 also illustrates the threaded end 52 of the split handle 44. The threaded end 52 allow for the handle locks 48, as shown in FIGS. 18 and 19, to be securely screwed into place and lock the two levers of the split handle 44 together. The handle lock 48 in FIG. 18 also includes an optional utility loop 50. The utility loop 50 allows the paint roller frame 10 to be tethered to a utility belt or safety line. The split handle 44 can be configured with one roller arm 14, or can be configured to include a second removable roller arm 14 as shown in FIG. 17. The removable roller arm 14 can be held in place in the split handle 44 via threading, a clip, a spring, or other similar means.

Figure 21:
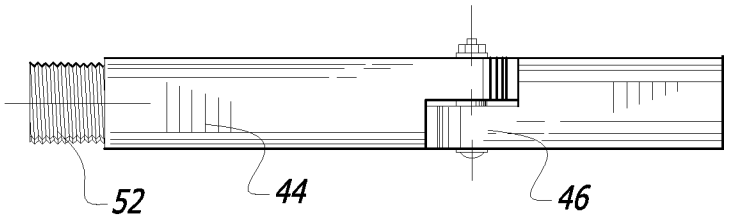
FIG. 21 is a side view of the split handle illustrating the threaded end.
Figure 22:
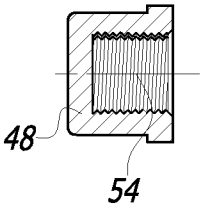
FIG. 22 is a side cut-away view of the handle lock illustrating the mating inner threads.
Figure 23:
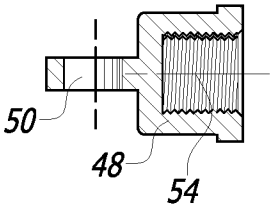
FIG. 23 is a side cut-away view of the handle lock with utility loop illustrating the mating inner threads.
Figure 20:
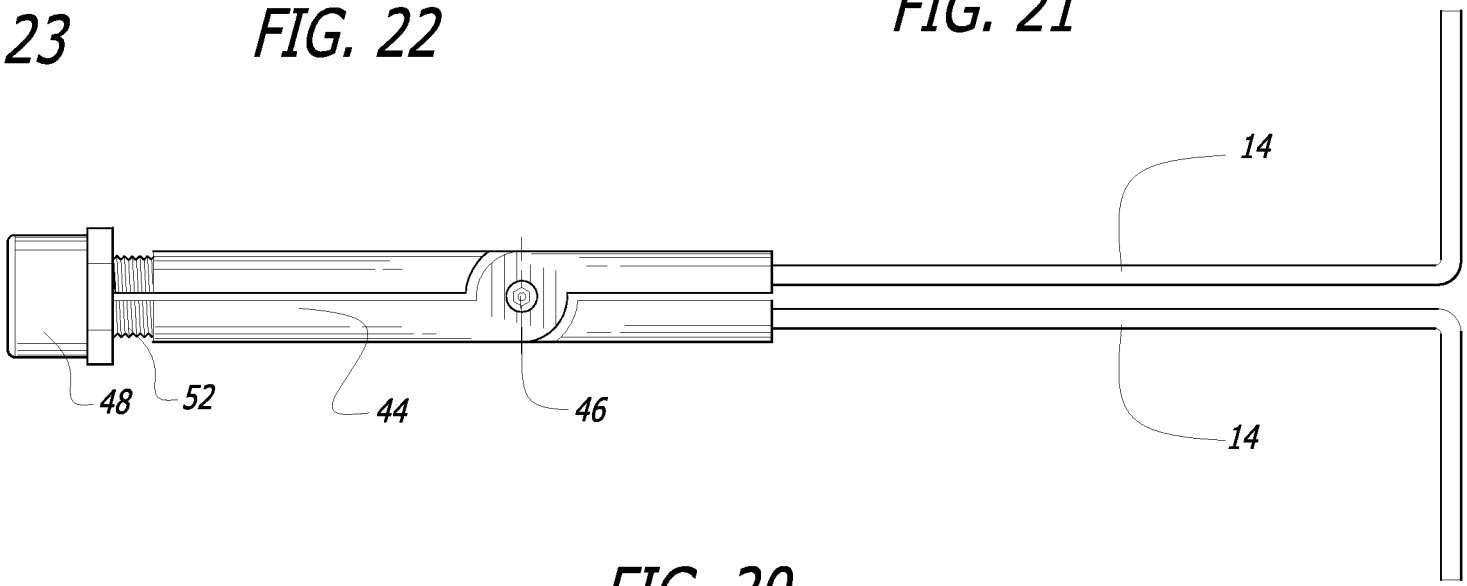
FIG. 20 is a side view of the adjustable length paint roller frame with split handle and double arms, illustrating the placement of the handle lock on the end of the split handle.

The adjustable length paint roller frame 10 embodiment with split handle 44 is illustrated in FIG. 20 with the handle lock 48 partially screwed onto the threaded end 52 of the split handle 44. The paint roller frame 10 is also shown with the optional second roller arm 14 attached. The threads along the two levers are configured to be continuous across the two lever ends at the threaded end 52 of the split handle 44. With this configuration, the handle lock 48 can be screwed into place over both levers at the threaded end 52. The threaded interior 54 of the handle lock 48 is illustrated in FIGS. 22 and 23. There it is shown that the threaded interior 54 of the handle lock 48 is deep enough to accommodate the threaded end 52 of the split handle 44 as shown in FIG. 21. The depth of the threaded interior 54 of the handle lock 48 does not change when the optional utility loop 50 is included, as in FIG. 23.

Figure 24:
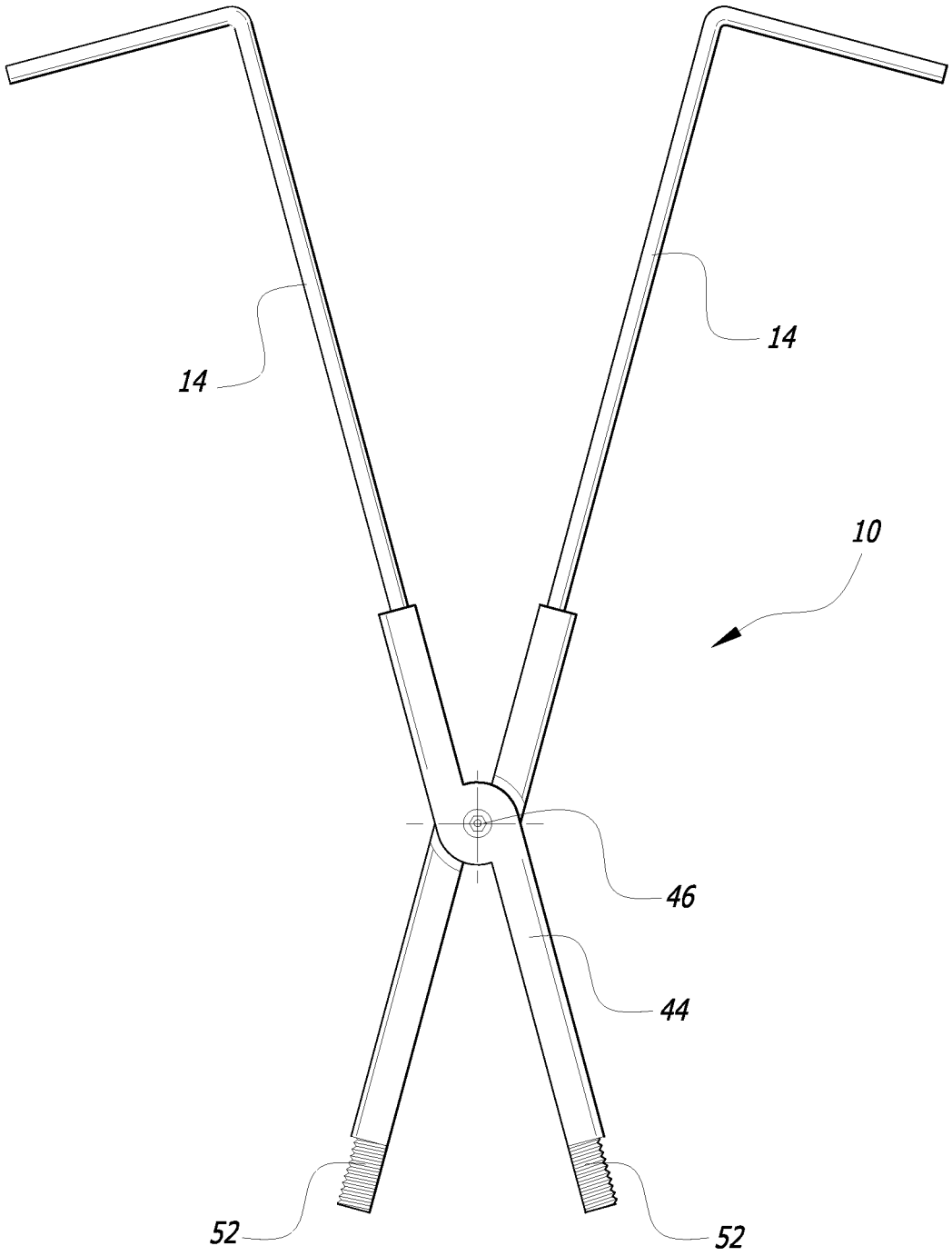
FIG. 24 is a side view of the adjustable length paint roller frame with split handle and double arms, illustrating the split handle about the pivot point, and the split in the threading at the threaded end.

The adjustable length paint roller frame 10 with split handle 44 and second roller arm 14 is shown in FIG. 24 with the two levers of the split handle 44 opened about the pivot 46. As shown, when the levers of the split handle 44 are opened near the threaded end 52, the roller arms 14 spread apart at the pivot 46. With the paint roller frame 10 in this configuration, the user can apply paint for a textured or faux finish. The roller arms 14 may also swivel in the split handle 44 so as to paint chair rails, beams, posts, and the like.

Figure 25:
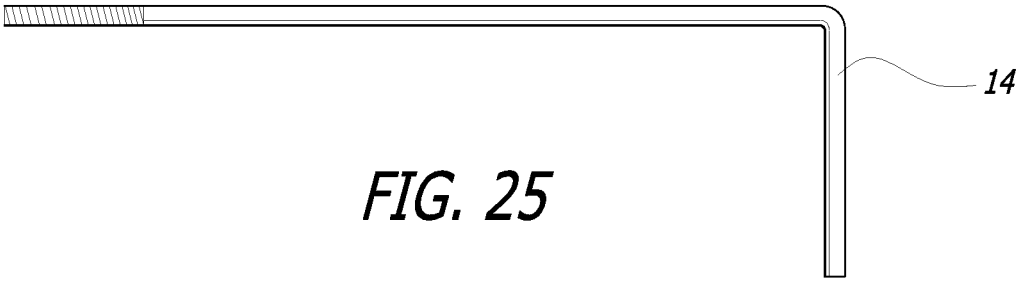
FIG. 25 is a side view of the roller arm separated from the split handle.
Figure 26:
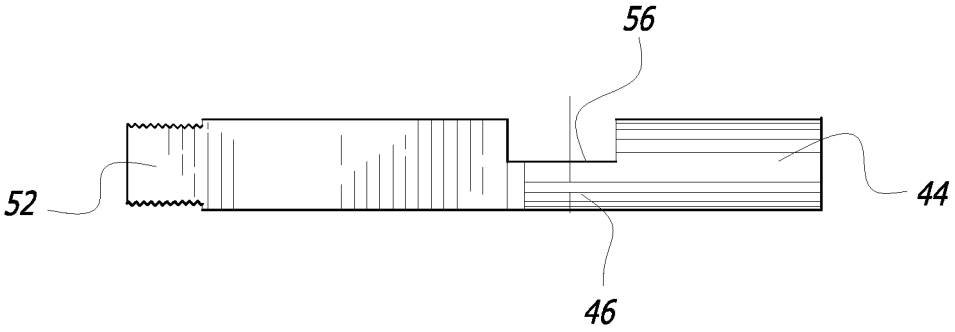
FIG. 26 is a side view of one-half of the split handle without an attached roller arm.

FIG. 25 illustrates the removable roller arm 14 separated from the split handle 44. FIG. 26 illustrates one lever of the split handle 44. The two levers are attached at the indentation 56 via the pivot 46. When attached in this way, the two lever arms of the split handle 44 are able to scissor open and shut about the pivot 46. When the two levers are scissored shut, the threaded ends 52 of the two levers form a continuous threading such that the handle lock 48 can be screwed thereon.

Although several embodiments have been described in detail for purposes of illustration, various modifications may be made without departing from the scope and spirit of the invention. Accordingly, the invention is not to be limited, except as by the appended claims.

What is claimed is:

1. An adjustable length paint roller frame, comprising:

a frame with two ends, comprising a handle at the first end and an arm at the second end, wherein the handle comprises a first lever pivotally connected to a second lever, the arm attached to the first lever;

locking means between the first and second levers;

a rotatable roller cover lock slidably mounted on the arm;

a rotatable roller cover mounted on the arm and removably attached to the roller cover lock; and a rotatable end cap removably mounted to the arm adjacent to the roller cover.

2. The adjustable length paint roller frame of claim 1, wherein the roller cover comprises an absorbent material.

3. The adjustable length paint roller frame of claim 2, wherein the absorbent material includes fabric, foam, lamb's wool or mohair.

4. The adjustable length paint roller frame of claim 1, wherein the roller cover lock is sized to create a tight fit with an interior of the roller cover.

5. The adjustable length paint roller frame of claim 4, further comprising means for enhancing the tight fit with the interior of the roller cover.

6. The adjustable length paint roller frame of claim 5, wherein the means for enhancing the tight fit are fins extending from the outer perimeter of the roller cover lock.

7. The adjustable length paint roller frame of claim 5, wherein the means for enhancing the tight fit are gripping teeth extending from the outer perimeter of the roller cover lock.

8. The adjustable length paint roller frame of claim 1, wherein the end cap is removably attached to the arm via a screw, a clamp, or a clip.

9. The adjustable length paint roller frame of claim 8, wherein the end cap comprises an absorbent cover.

10. The adjustable length paint roller frame of claim 9, wherein the absorbent cover comprises fabric, foam, lamb's wool or mohair.

11. The adjustable length paint roller frame of claim 8, wherein the end cap comprises an adjustable length roller guide.

12. The adjustable length paint roller frame of claim 11, wherein the adjustable length roller guide is extendable and spaces the roller cover a larger or smaller distance away from a given object.

13. The adjustable length paint roller frame of claim 1, including a second arm attached to the second lever.

* * * * *